US006114616A

United States Patent [19]

Naylor

[11] Patent Number: 6,114,616

[45] Date of Patent: Sep. 5, 2000

[54] GUITAR BODY

[76] Inventor: Joseph F. Naylor, 28430 Herbert St., Madison Heights, Mich. 48071

[21] Appl. No.: 09/289,445

[22] Filed: Apr. 9, 1999

Related U.S. Application Data

[60] Provisional application No. 60/081,317, Apr. 10, 1998.

[51] Int. Cl.[7] ..... G10D 3/00

[52] U.S. Cl. ..... 84/291; 84/290

[58] Field of Search ..... 84/290, 291, 275, 84/276

[56] References Cited

U.S. PATENT DOCUMENTS

| | | | |
|---|---|---|---|
| 3,880,040 | 4/1975 | Kaman | 84/291 |
| 4,538,497 | 9/1985 | Smith | 84/291 |
| 5,235,891 | 8/1993 | Klein | 84/291 |
| 5,339,718 | 8/1994 | Leduc | 84/291 |
| 5,406,874 | 4/1995 | Witchel | 84/291 |
| 5,661,252 | 8/1997 | Krawczak | 84/291 |

*Primary Examiner*—Bentsu Ro
*Assistant Examiner*—Kim Lockett
*Attorney, Agent, or Firm*—Reising, Ethington, Barnes, Kisselle, Learman & McCulloch, P.C.

[57] ABSTRACT

A body for a guitar or other musical instrument includes a molded plastic rim, a wood center block attached within the rim, a metal sustain bar attached to the center block, top and bottom pre-finished phenolic laminates attached on either side of the rim and center block, and a cover plate attached over a cutout in the top laminate. The wood center block extends longitudinally across the rim and attaches at each end to a portion of the inner surface of the rim. The laminates are then adhered to the center block and rim and are thereafter beveled along with the edge of the rim to create a finished, multicolored angled edge. The cutout in the top laminate is formed by a routing operation that is also used to machine away a portion of the center block to a depth suitable to accommodate the pickups and other electronic components mounted to the cover plate. The top laminate, center block, and rim are also machined away at one end to form a recessed portion that receives a guitar neck. Thereafter, the cover plate is attached over the cutout by screws, thereby completing the body assembly operation.

21 Claims, 2 Drawing Sheets

GUITAR BODY

This application claims benefit of Provisional Application 60/081,317 filed Apr. 10, 1998.

TECHNICAL FIELD

The present invention relates to techniques for constructing guitar bodies and the like.

BACKGROUND OF THE INVENTION

In the design of electric and acoustic guitars, there are several factors that dominate the design process. Principal among these are acoustical quality, aesthetics, and cost. The acoustical quality of the resulting instrument depends heavily on the construction of the guitar body. The design factors that affect the resulting guitar sound primarily include the body material (e.g., wood or plastic), as well as the existence and properties of hollow cavities within the guitar body. To minimize manufacturing costs, the guitar body is preferably made in a manner which utilizes inexpensive materials that can be easily formed into the desired configuration and then assembled easily. The aesthetic elements include design features such as the overall body shape, and also include other features that are applied as a post-assembly operation, such as painting and additional ornamentation that is added to the assembled body.

As is known, electronic guitar bodies are sometimes cut from solid wood, then formed into the desired overall shape, machined to produce space for the pickups, audio jack, and other electrical components, and then painted with one or more colors in varying detail to obtain the desired aesthetic finish. In these solid body constructions, a cavity may also be machined for insertion of a metal sustain bar that gives the finished guitar an improved sound. It is also known in the construction of solid guitar bodies to cover the body with a pre-finished phenolic laminate. For semi-hollow guitar bodies, the process is somewhat more complicated. Typically, a semi-hollow guitar body will include an outer rim made of plywood or cut from solid wood. A longitudinally oriented center block is then inserted within the rim, followed by top and bottom sheets of plywood or solid wood that are attached on either side of the rim and center block. This produces a guitar body with internal cavities, one of which is accessed by a cutout in the top wood sheet. The guitar pickups, audio jack, volume, and other controls are mounted on a pick guard, which is secured in place over the cutout in the top wooden sheet. Thereafter, the entire body is finished, typically by painting.

Often, there is a significant tradeoff between acoustic quality, cost, and to a lesser extent, aesthetics. That is, while a particular design may be aesthetically pleasing and inexpensive to manufacture, the resulting audio quality may be unacceptable to both professional and amateur musicians. For example, in the semi-hollow guitar bodies noted above, a significant amount of effort and, thus, cost is incurred in shaping the outer rim and finishing the assembled guitar body. Accordingly, there exists a need for a guitar body that produces good sound, yet can be manufactured in an inexpensive manner that allows significant flexibility in the aesthetic features of the resulting guitar body.

SUMMARY OF THE INVENTION

The present invention provides a body construction for a guitar or other musical instrument which enables simple, low-cost construction of the body in a manner that produces good sound quality and an aesthetically pleasing final product that requires no painting or other post construction finishing. The body includes a molded plastic rim, a center block attached within the rim, a sustain bar attached to the center block, top and bottom laminates that attach to the rim to enclose the center block and sustain bar, a cover plate attached over a cutout in the top laminate. The center block extends from one side of the rim to the other and attaches at each end to a portion of the inner surface of the rim. The rim, center block, and top and bottom laminates together define at least one internal cavity, with the cutout in the top laminate providing access into that cavity such that one or more electrical components attached to the cover plate extend down into the cavity when the cover plate is assembled in place over the cutout.

Preferably, the center block comprises a wood block having opposed ends, each of which are formed into a shape which corresponds to the shape of the portion of the inner surface of the rim to which it is attached. The sustain bar can be a metal bar that is rigidly attached to the wood center block to promote long note sustain during use of the guitar. When used for a guitar body, the center block can extend longitudinally across the length of the rim and can include a recessed portion that is adapted to receive a guitar neck that extends outwardly from the guitar body in the longitudinal direction.

In accordance with another aspect of the invention, there is provided a method of constructing a body for a musical instrument such as a guitar. The method includes the steps of molding a plastic rim, securing a center block to the inner surface of the rim, attaching a top laminate to the center block and top edge of the rim, attaching a bottom laminate to the center block and the bottom edge of the rim, forming a cutout in the top laminate, and affixing a cover plate to the top laminate over the cutout. The center block can be made from wood by forming a first end in the wood having a contour that mates with a first portion of the inner surface of the rim, forming a second end in the wood having a contour that mates with a second portion of the inner surface of the rim, and then gluing the wood center block to the first and second portions of the inner surface of the rim using a hot-melt adhesive. The top and bottom laminates can be precut or be attached over the center block and rim and then cut to a shape that substantially corresponds to the rim. Preferably, this is done by routing the laminates around the contour of the rim. This routing operation can also be used to provide a beveled edge to the laminates and rim that produces an aesthetically pleasing multicolored angled body edge.

BRIEF DESCRIPTION OF THE DRAWINGS

A preferred exemplary embodiment of the invention will now be described in conjunction with the appended drawings, wherein like numerals denote like elements and wherein.

DESCRIPTION OF THE PREFERRED EMBODIMENT

Figure 1:
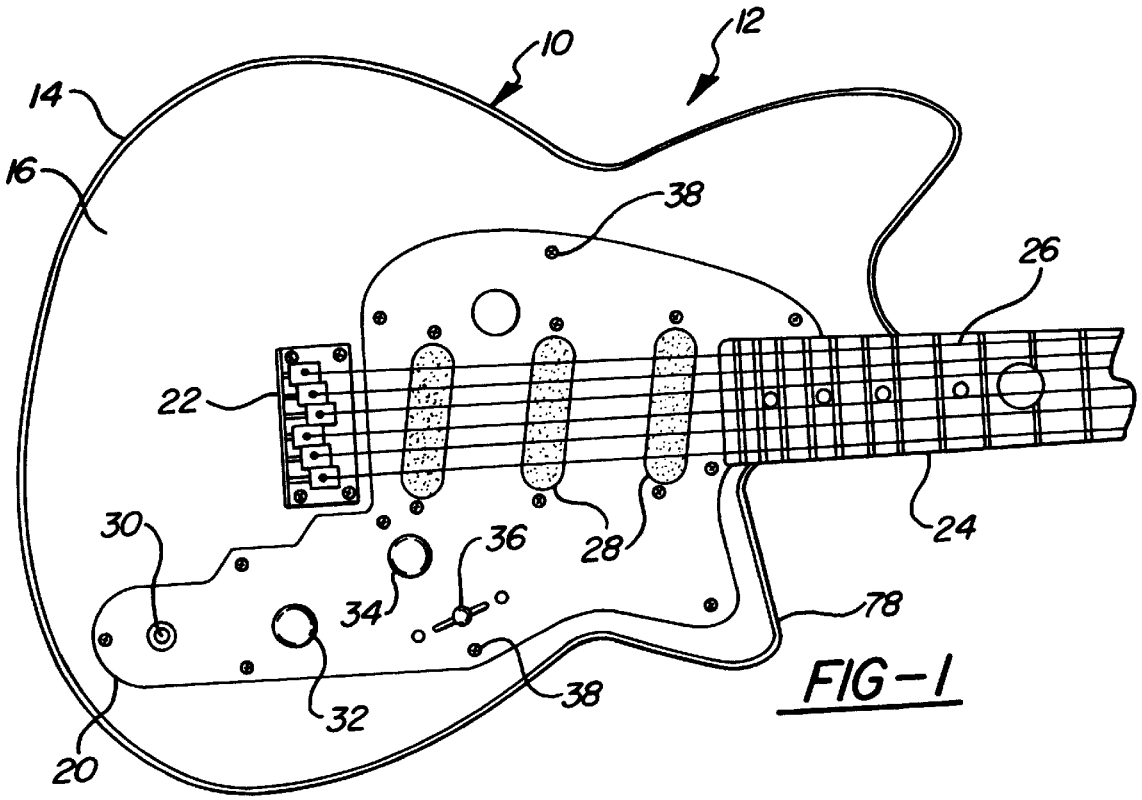
FIG. 1 depicts a preferred embodiment of an electric guitar body of the present invention.

Referring first to FIG. 1, there is shown a guitar body 10 of the present invention as it would be utilized for an electric guitar 12. In general, guitar body 10 includes the following exterior components: an outer plastic rim 14, a top laminate 16, bottom laminate 18 (shown in FIGS. 3 and 5), and a cover plate or pick guard 20. After final assembly of guitar body 10, a conventional bridge 22, neck 24, and head stock (not shown) can be attached, followed by stringing of the guitar 12 with guitar strings 26. Pick guard 20 includes a number of electronic components mounted thereon, including one or more pickups 28, an audio jack 30, tone and volume controls 32, 34, and, if necessary, a pickup selector switch 36. These components are mounted in a conventional manner to pick guard 20 which is attached to the remainder of guitar body 10 via screws 38.

Figure 2:
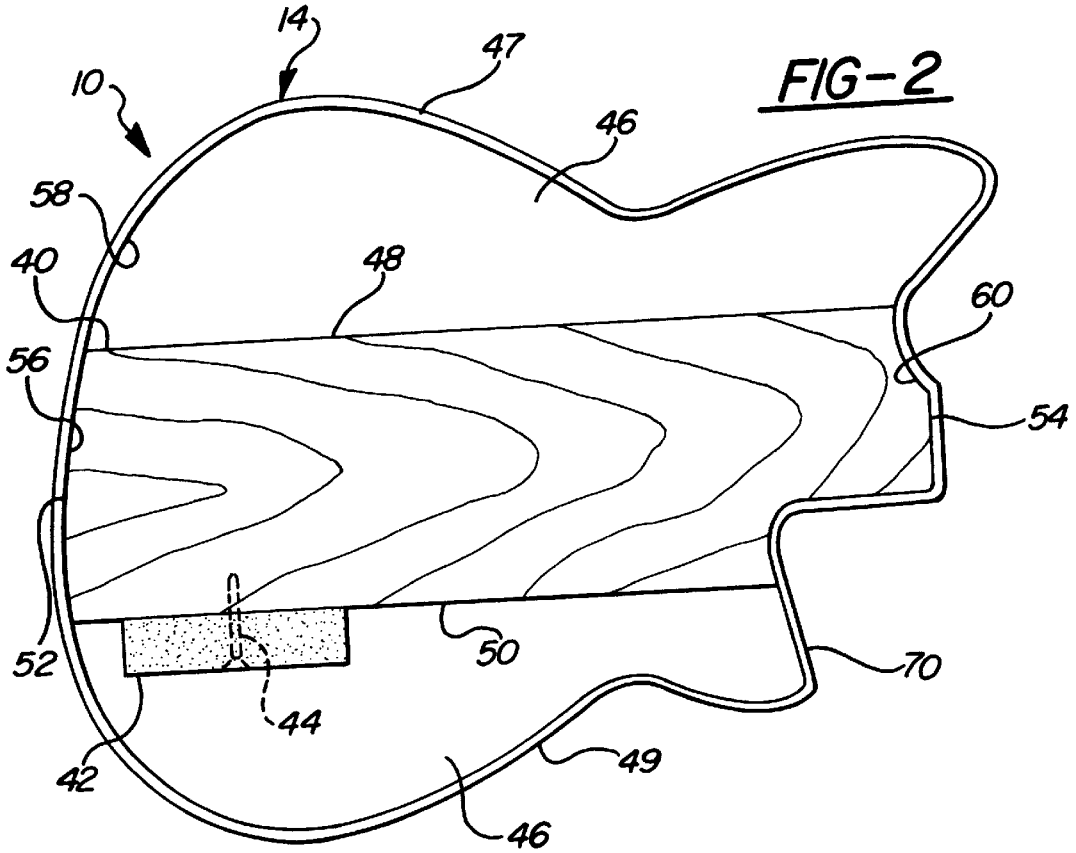
FIG. 2 is a view showing the first stage of construction and assembly of the guitar body of FIG. 1.

Referring now also to FIG. 2, there is shown the interior components of guitar body 10 that are formed and assembled together as a part of the first-stage construction of guitar body 10. These interior components include a center block 40 that is attached to rim 14 and a sustain bar 42 that is connected to center block 40 using a screw 44. As shown, rim 14 is an injection molded component, preferably made from high-impact styrene. The width of rim 14 determines the overall width of guitar body 10 and can be selected as desired. The thickness of rim 14 can be selected to give the desired amount of structural rigidity to guitar body 10.

Center block 40 is preferably constructed from wood. As shown, center block 40 does not fill the entire space within rim 14, rather it extends longitudinally across rim 14, thereby creating a pair of intervening spaces 46 between respective portions 47, 49 of rim 14 and the longitudinally extending edges 48, 50 of center block 40. This provides an acoustical cavity within guitar body 10 as well as space for many of the electrical components shown in FIG. 1. This also enables center block 40 to be made from widely available wood stock without having to join multiple pieces of wood together. Center block 40 extends from a first end 52 to a second end 54. The first end 52 is machined to provide it with a contour that mates with a corresponding portion 56 of the inner surface 58 of rim 14. Similarly, the second end 54 of center block 40 is cut and finished so that it has a contour that corresponds to a second portion 60 of the rim's inner surface 58. These ends 52 and 54 are spaced from one another by the same length as the distance between the portions 56, 60 of rim 14 so that center block 40 can be easily inserted into place within rim 14 and adhered to inner surface 58 using a hot-melt adhesive.

Figure 3:
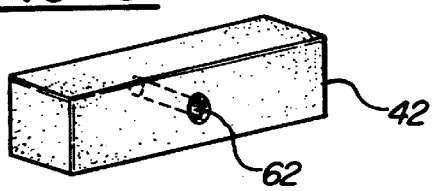
FIG. 3 is a perspective view of a sustain bar used in the guitar of FIG. 1.

Sustain bar 42 is attached near the bridge area of center block 40 using screw 44 along with hot-melt adhesive. Preferably, sustain bar 42 is located as shown, although it will be appreciated that it could be attached to center block 40 at other locations as is necessary to attain the desired acoustical effect. The construction of sustain bar 42 is shown in FIG. 3. Sustain bar 42 comprises a block of steel having a length of three and one-half inches and a width and height of one inch. A countersunk clearance hole 62 for screw 44 is located at the center of a longitudinal side of sustain bar 42.

Figure 4:
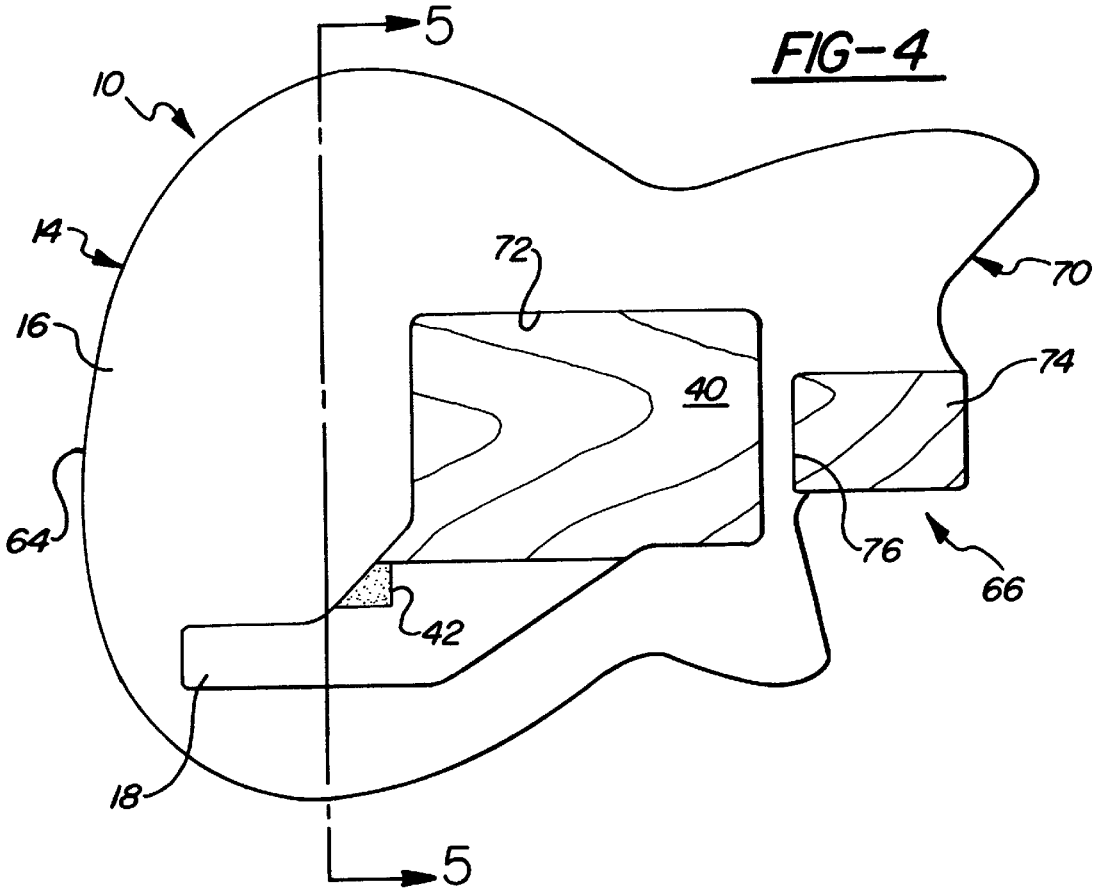
FIG. 4 is a view showing the second stage of the construction and assembly of the guitar body of FIG. 1.

Turning now to FIG. 4, there is shown guitar body 10 as it exists after the second stage construction operation. As shown, once rim 14, center block 40, and sustain bar 42 have been assembled together, top laminate 16 and bottom laminate 18 are then attached to center block 40 and the top and bottom edges 63, 65, respectively, of rim 14. Top laminate 16 has a marginal edge 64 that corresponds in shape to rim 14, except at an area 66 where the neck 24 is connected. Similarly, bottom laminate 18 includes a marginal edge 68 (FIG. 5) that corresponds in shape to rim 14. Laminates 16 and 18 preferably comprise a pre-finished phenolic laminate top, such as is available under the brand name Formica. Although laminate 16 and 18 can be precut to the desired shape, they are preferably cut roughly to size, attached to rim 14 and center block 40 using cyanoacrylate glue, and are thereafter finished to the final shape. This can be done by forming the marginal edges 64, 68 using a router that is run around the outer surface 70 of rim 14.

Top laminate 16 includes a cutout 72 over which pick guard 20 is secured as a part of the final assembly step of body 10. As with top marginal edge 64, cutout 72 can be preformed in laminate 16. However, cutout 72 is preferably formed after assembly of laminate 16 onto rim 14 and center block 40. This post assembly formation of cutout 72 can be accomplished using a router to machine laminate 16 and center block 40 to an appropriate depth to receive the electrical components mounted on pick guard 20. For attachment of the guitar neck 24, a second area of laminate 16 and center block 40 is also machined away along with a portion of rim 14. This creates a recessed portion 74 in center block 40 and provides the top marginal edge 64 of laminate 16 with a segment 76 that extends around the recessed portion 74. This enables the guitar neck 24 to be attached directly to center block 40.

Figure 5A:
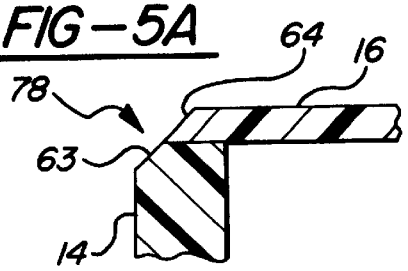
FIG. 5A is an enlarged fragmentary view of the guitar body outer edge shown in FIG. 5.
Figure 5:
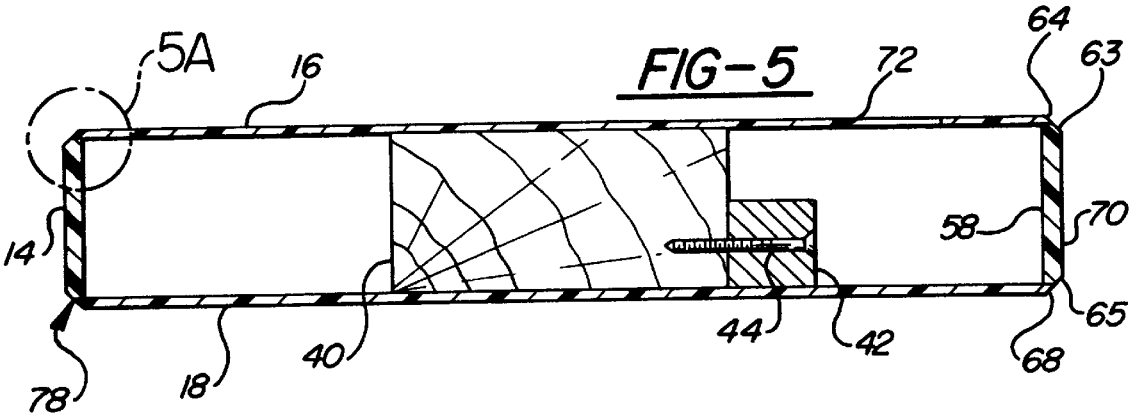
FIG. 5 is a cross-sectional view taken along the 5—5 line of FIG. 4.

Referring now to FIG. 5, there is shown a cross-sectional view of guitar body 10. As shown, sustain bar 42 is mounted to center block 40 in contact with bottom laminate 18. Of course, it will be appreciated that sustain bar 42 can be attached to center block 40 at a location that is in contact with top laminate 16 or at a location that is not in contact with either laminate. As mentioned above, the respective marginal edges 64 and 68 of top and bottom laminates 16 and 18 are preferably formed by routing of the laminates after their assembly onto rim 14 and center block 40. This routing operation can be used to provide a 45° beveled edge 78. As shown in FIG. 5A, rim 14 is preferably beveled along with the marginal edges, resulting in an aesthetically pleasing multicolored angled edge. Referring briefly back to FIG. 1, once all of the routing operations are complete, pick guard 20 is secured in place over cutout 72 using screws 38. Some of these screws penetrate into center block 40. Others extend down into the intervening space 46 between rim 14 and center block 40 and, for these screws, small wooden blocks can be located under top laminate 16 to accept the screw threads.

As will be appreciated by those skilled in the art, the use of injection-molded rim 14 and top and bottom laminate 16, 18 provides a body construction that, once assembled, requires no painting or other post construction finishing. Also, the use of center block 40 provides the needed structural rigidity using widely available wood stock, with sustain bar 42 being used to promote long note sustain that is not typical of semi-hollow instruments such as electric guitar 12.

It will thus be apparent that there has been provided in accordance with the present invention a guitar body and method of constructing the same which achieves the aims and advantages specified herein. It will, of course, be understood that the foregoing description is of a preferred exemplary embodiment and that the invention is not limited to the embodiment shown. Various changes and modifications will be apparent to those skilled in the art. For example, although the invention has been described as it would be utilized in the construction of an electric guitar, it will be appreciated that it can be utilized in the construction of bass and other string instruments. All such changes and modifications are intended to come within the scope of the appended claims.

I claim:

1. A body for a musical instrument, comprising:

a molded plastic rim having an inner surface and an outer surface;

a center block attached within said rim and extending from a first portion of said inner surface to a second portion of said inner surface, wherein said rim includes third and fourth portions that extend between said first and second portions on opposite sides of said center block and wherein said third and fourth portions are each separated from said center block by an intervening space;

a sustain bar attached to said center block;

a bottom laminate attached to said rim and a first face of said center block, said bottom laminate having a bottom marginal edge that corresponds in shape to said rim;

a top laminate attached to said rim and a second face of said center block such that said center block is located between said top and bottom laminates, said top laminate having a top marginal edge that corresponds in shape to at least a portion of said rim, wherein said rim, center block, and laminates together define at least one internal cavity, said top laminate further having at least one cutout that provides access into said internal cavity; and a cover plate attached to said top laminate over said cutout, said cover plate including at least one electrical component mounted thereon that extends into one of said intervening spaces.

2. A body as defined in claim 1, wherein said center block comprises a wood block having a pair of opposing ends, each of which is adhered to one of said portions of said inner surface.

3. A body for a musical instrument, comprising:

a molded plastic rim having an inner surface and an outer surface;

a center block attached within said rim and extending from a first portion of said inner surface to a second portion of said inner surface, said center block comprising a wood block having a pair of opposing ends, each of which is adhered to one of said first and second portions of said inner surface, wherein said rim further includes third and fourth portions that extend between said first and second portions on opposite sides of said center block and wherein said third and fourth portions are each separated from said center block by an intervening space;

a sustain bar attached to said center block;

a bottom laminate attached to said rim and having a bottom marginal edge that corresponds in shape to said rim; and a top laminate attached to said rim opposite said bottom laminate, said top laminate having a top marginal edge that corresponds in shape to at least a portion of said rim, whereby said rim center block, and laminates together define at least one internal cavity;

wherein said sustain bar comprises a metal bar attached to said wood block in one of said intervening spaces.

4. A body as defined in claim 6, wherein said recessed portion of said center block comprises a machined recess in said center block and wherein said segment of said top marginal edge comprises a cutout in said top laminate.

5. A body for a musical instrument, comprising:

a molded plastic rim having an inner surface and an outer surface;

a center block attached within said rim and extending from a first portion of said inner surface to a second portion of said inner surface, said center block comprising a wood block having a pair of opposing ends, each of which is adhered to one of said portions of said inner surface;

a sustain bar attached to said center block;

a bottom laminate attached to said rim and having a bottom marginal edge that corresponds in shape to said rim;

a top laminate attached to said rim opposite said bottom laminate, said top laminate having a top marginal edge that corresponds in shape to at least a portion of said rim, whereby said rim, center block, and laminates together define at least one internal cavity, said top laminate further having at least one cutout that provides access into said internal cavity; and a cover plate attached to said top laminate over said cutout, said cover plate including at least one electrical component mounted thereon that extends into said internal cavity;

wherein said wood block and said rim have an equal height and wherein said laminates are adhered to opposing faces of said wood block.

6. A body as defined in claim 1, wherein said center block includes a recessed portion that is located adjacent said first portion of said inner surface of said rim and wherein said top marginal edge includes a segment that extends around said recessed portion to thereby permit attachment of a guitar neck directly to said center block.

7. A body for a musical instrument, comprising:

a molded plastic rim having an inner surface and an outer surface;

a center block attached within said rim and extending from a first portion of said inner surface to a second portion of said inner surface, a sustain bar attached to said center block;

a bottom laminate attached to said rim and having a bottom marginal edge that corresponds in shape to said rim;

a top laminate attached to said rim opposite said bottom laminate, said top laminate having a top marginal edge that corresponds in shape to at least a portion of said rim, whereby said rim, center block, and laminates together define at least one internal cavity, said top laminate further having at least one cutout that provides access into said internal cavity; and a cover plate attached to said top laminate over said cutout, said cover plate including at least one electrical component mounted thereon that extends into said internal cavity;

wherein said center block includes a recessed portion that is located adjacent said first portion of said inner surface of said rim and wherein said top marginal edge includes a segment that extends around said recessed portion to thereby permit attachment of a guitar neck directly to said center block; and wherein said recessed portion of said center block comprises a machined recess in said center block, with said segment of said top marginal edge comprising a cutout in said top laminate that is separate from said cutout that provides access into said internal cavity.

8. A body for a musical instrument, comprising:

a molded plastic rim having an inner surface and an outer surface;

a center block attached within said rim and extending from a first portion of said inner surface to a second portion of said inner surface, a sustain bar attached to said center block;

a bottom laminate attached to said rim and having a bottom marginal edge that corresponds in shape to said rim;

a top laminate attached to said rim opposite said bottom laminate, said top laminate having a top marginal edge that corresponds in shape to at least a portion of said rim, whereby said rim, center block, and laminates together define at least one internal cavity, said top laminate further having at least one cutout that provides access into said internal cavity; and a cover plate attached to said top laminate over said cutout, said cover plate including at least one electrical component mounted thereon that extends into said internal cavity;

wherein said rim has top and bottom edges, and wherein said top marginal edge of said top laminate and said top edge of said rim together define a top beveled edge, and wherein said bottom marginal edge of said bottom laminate and said bottom edge of said rim together define a bottom beveled edge.

9. A body for a musical instrument, comprising:

a molded plastic rim having an inner surface and an outer surface;

a center block attached within said rim and extending from a first portion of said inner surface to a second portion of said inner surface, a sustain bar attached to said center block;

a bottom laminate attached to said rim and having a bottom marginal edge that corresponds in shape to said rim;

a top laminate attached to said rim opposite said bottom laminate, said top laminate having a top marginal edge that corresponds in shape to at least a portion of said rim, whereby said rim, center block, and laminates together define at least one internal cavity, said top laminate further having at least one cutout that provides access into said internal cavity; and a cover plate attached to said top laminate over said cutout, said cover plate including at least one electrical component mounted thereon that extends into said internal cavity;

wherein said plastic rim comprises styrene and wherein said top and bottom laminates comprise a pre-finished phenolic laminate.

10. A method of constructing a body for a musical instrument, comprising the steps of:

molding a plastic rim having an inner surface, an outer surface, and top and bottom edges;

securing a first end of a center block to a first portion of said inner surface of said plastic rim;

securing a second end of said center block to a second portion of said inner surface of said plastic rim;

attaching a top laminate to a first face of said center block and to said top edge of said rim;

attaching a bottom laminate to a second face of said center block and to said bottom edge of said rim;

forming a cutout in said top laminate; and affixing a cover plate to said top laminate over said cutout.

11. A method of constructing a body for a musical instrument, comprising the steps of:

molding a plastic rim having an inner surface, an outer surfaces and top and bottom edges;

creating said center block using wood by forming a first end in said wood having a contour that mates with a first portion of said inner surface of said rim and forming a second end in said wood having a contour that mates with a second portion of said inner surface, with the distance between said first and second ends being equal to the distance between said first and second portions of said rim;

securing said center block to said inner surface of said plastic rim;

attaching a top laminate to said center block and said top edge of said rim;

attaching a bottom laminate to said center block and said bottom edge of said rim;

forming a cutout in said top laminate; and affixing a cover plate to said top laminate over said cutout.

12. A method as defined in claim 11, further comprising the step of machining said laminate and center block to form a recessed portion that is dimensioned to receive a guitar neck.

13. A method of constructing a body for a musical instrument, comprising the steps of:

molding a plastic rim having an inner surface, an outer surface, and top and bottom edges;

securing a center block to said inner surface of said plastic rim;

attaching a top laminate to said center block and said top edge of said rim;

attaching a bottom laminate to said center block and said bottom edge of said rim;

forming a marginal edge on said top laminate that corresponds in shape to at least a portion of said top edge of said plastic rim;

forming a marginal edge on said bottom laminate that substantially corresponds in shape to said bottom edge of said plastic rim;

forming a cutout in said top laminate; and affixing a cover plate to said top laminate over said cutout.

14. A method as defined in claim 15, wherein said steps of forming said marginal edges further comprise beveling said edges after said laminates have been attached to said plastic rim.

15. A method as defined in claim 11, further comprising the step of creating at least one cavity within the body using said center block, plastic rim, and laminates.

16. A method as defined in claim 17, further comprising the step of attaching a sustain bar to said center block within said cavity.

17. A method of constructing a body for a musical instrument, comprising the steps of:

molding a plastic rim having an inner surface, an outer surface, and top and bottom edges;

securing a center block to said inner surface of said plastic rim;

attaching a top laminate to said center block and said top edge of said rim;

attaching a bottom laminate to said center block and said bottom edge of said rim;

forming a cutout in said top laminate; and affixing a cover plate to said top laminate over said cutout;

wherein said forming step is carried out after said attaching steps.

18. A method as defined in claim 17, wherein said forming step further comprises forming said cutout at least partially over said cavity.

19. A method of constructing a body for a musical instrument, comprising the steps of:

molding a plastic rim having an inner surface, an outer surface, and top and bottom edges;

securing a center block to said inner surface of said plastic rim;

attaching a top laminate to said center block and said top edge of said rim;

attaching a bottom laminate to said center block and said bottom edge of said rim;

forming a cutout in said top laminate; and affixing a cover plate to said top laminate over said cutout;

wherein said cover plate comprises a pick guard having one or more electrical components mounted thereon and wherein said affixing step further comprises affixing said pick guard over at least a portion of said cavity such that said one or more electrical components extend into said cavity.

20. A semi-hollow electric guitar body, comprising:

a molded plastic rim having an inner surface and an outer surface;

a center block attached within said rim and extending from a first portion of said inner surface to a second portion of said inner surface, wherein said rim includes third and fourth portions that extend between said first and second portions on opposite sides of said center block and wherein said third and fourth portions are each separated from said center block by an intervening space;

a bottom phenolic laminate attached to said rim and said center block; and a top phenolic laminate attached to said rim and said center block opposite said bottom laminate such that said center block and each of said intervening spaces are located between said top and bottom laminates with said laminates being attached to opposing faces of said center block, whereby said rim, center block, and laminates form a semi-hollow guitar body having a pair of separate, internal cavities located at said opposite sides of said center block.

21. A semi-hollow electric guitar body as defined in claim 20, further comprising a sustain bar attached to one of said sides of said center block within one of said internal cavities.

* * * * *